United States Patent [19]

Richardson, Jr. et al.

[11] 4,025,239

[45] May 24, 1977

[54] RECIPROCATING COMPRESSORS

[75] Inventors: Hubert Richardson, Jr., Kirkville; Thomas W. Carter, Baldwinsville, both of N.Y.

[73] Assignee: Carrier Corporation, Syracuse, N.Y.

[22] Filed: Dec. 30, 1975

[21] Appl. No.: 645,163

[52] U.S. Cl. ..... 417/292; 62/196 C

[51] Int. Cl.[2] ..... F04B 49/00

[58] Field of Search ..... 62/196 C; 417/292, 299

[56] References Cited

UNITED STATES PATENTS

| | | | |
|---|---|---|---|
| 1,607,657 | 11/1926 | Whitehead | 230/64 |
| 2,520,674 | 8/1950 | Baschmann | 62/196 C |
| 3,606,588 | 9/1971 | Romehaus | 417/292 |
| 3,759,057 | 9/1973 | English | 62/196 C |

*Primary Examiner*—Alan Cohan

*Attorney, Agent, or Firm*—J. Raymond Curtin; Barry E. Deutsch

[57] ABSTRACT

A reciprocating compressor includes a conduit to communicate a first portion operating at compressor suction pressure with a second portion of the compressor operating at compressor discharge pressure. A valve responsive to the temperature of the fluid compressed by the operation of the compressor is provided to control the flow of the fluid through the conduit. The valve is in a normally open position to permit flow of fluid through the conduit when the temperature of the fluid is at a relatively low level. As the compressor continues to operate, the temperature level of the fluid increases whereby the valve is placed in a closed position to terminate the flow of fluid through the conduit.

7 Claims, 5 Drawing Figures

RECIPROCATING COMPRESSORS

BACKGROUND OF THE INVENTION

This invention relates to improvements in reciprocating compressors, and in particular, to a system to reduce the load on the compressor upon initial startup thereof.

Reciprocating compressors are employed in many varied conditions. In a number of applications, the compressor is designed to operate under a constant load. Accordingly, an electric motor typically employed to drive such compressor may be chosen to provide sufficient torque to handle the load imposed thereon, even during initial starting conditions. It is understood, the motor employed to drive the compressor will not provide maximum torque until it attains normal operating speed.

In other applications, the compressor operates in systems wherein a variable load may be imposed thereon. An electric motor may be chosen to provide sufficient torque at starting conditions to manage the maximum load that might be imposed on the compressor. However, the use of such a motor would not be economical. The relatively few times the motor would be employed under such adverse conditions does not warrant the increased cost in providing windings capable of carrying the large flow of current that would occur during the starting period of a compressor having a relatively large load imposed thereon.

The use of a compressor in a refrigeration unit is a typical variable load application. At times when the ambient temperature is at a relatively high level, the condensing pressure of the refrigeration unit is similarly at a high level. Compressor discharge pressure must be slightly above condenser pressure. Accordingly, the initial load on the compressor is relatively high.

Under heavy load conditions, the motor will draw excessive current in an attempt to produce the necessary torque to attain operating speed. The excessive current may damage the motor windings or more likely, trip the safety device employed to prevent the windings from being damaged by the excessive current. If the load imposed on the compressor is unusuallly large, the motor may stall producing locked rotor conditions which may result in the total destruction of the motor.

In U.S. Pat. No. 1,607,657, there is disclosed a thermostatically controlled needle valve to permit the cylinder to be vented to atmosphere to facilitate starting of the compressor. The use of an expansible bellows in combination with a needle valve provides a rather costly and cumbersome arrangement to obtain the desired reduced load on the compressor.

It has been determined that an effective means for reducing the initial load on the compressor can be accomplished by communicating a portion of the compressor operating at compressor discharge pressure with a portion operating at suction pressure. This permits a portion of the relatively warm high pressure fluid to mix with the relatively cold low pressure fluid. The temperature of the suction fluid is thus increased, thereby lowering its density. By decreasing the density of the suction fluid, the compressor is required to do less work in compressing the fluid to attain discharge pressure.

Additionally, the suction pressure of the fluid is increased as a result of the introduction of fluid at discharge pressure into the suction side of the compressor. By increasing the suction pressure of the gas, the pressure differential across the compressor is reduced, thereby further decreasing the starting load thereon.

SUMMARY OF THE INVENTION

Accordingly, it is an object of this invention to reduce the load imposed on a compressor during starting conditions.

It is a further object of this invention to automatically reduce the load imposed on a compressor to facilitate the starting thereof.

It is a further object of this invention to unload a compressor during startup conditions by highly reliable compact and relatively inexpensive unloading means.

It is yet another object of this invention to communicate a portion of the compressor operating at discharge pressure with a portion operating at suction pressure when the compressor is started.

These and other objects of the present invention are attained in a reciprocating compressor including conduit means to communicate a first portion of the compressor operating at compressor suction pressure with a second portion of the compressor at compressor discharge pressure. Valve means responsive to the temperature of the fluid is provided to control the flow of the fluid through the conduit. The valve means is in a normally open position when the temperature of the fluid is at a relatively low level to permit the flow of fluid from the second portion of the compressor to the first portion thereof. The valve means moves to a closed position relative to the conduit means to terminate the flow of fluid through the conduit means as the temperature of the fluid increases due to continued operation of the compressor.

DESCRIPTION OF THE PREFERRED EMBODIMENTS

Figure 1:
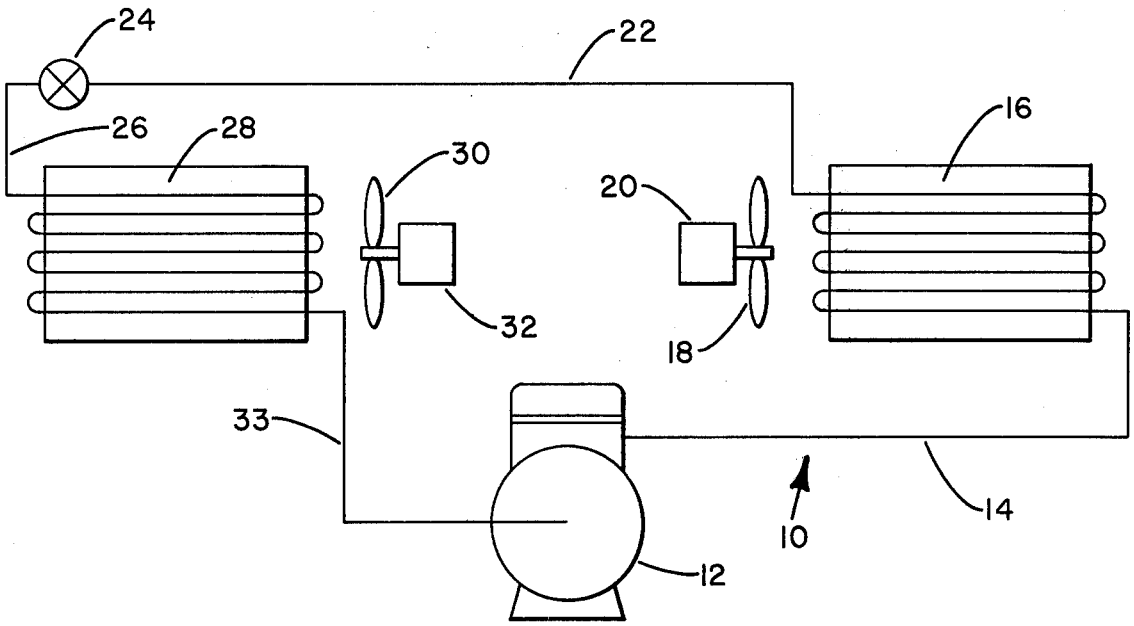
FIG. 1 is a schematic illustration of a refrigeration unit having a reciprocating compressor including the invention disclosed herein.

Referring now to the drawings, there is disclosed preferred embodiments of the present invention as employed in an application having a variable load. In referring to the various figures of the drawings, like numerals shall refer to like parts.

Referring now to FIG. 1, there is schematically illustrated a refrigeration unit which is typically employed in an air conditioning system. A refrigeration unit represents a variable load application in which the instant invention may be suitably employed. Refrigeration unit 10 includes compressor 12, illustrated as a reciprocating compressor. High pressure refrigerant gas is discharged from compressor 12, through conduit 14, to a first heat exchanger 16 functioning as a refrigerant condenser. A relatively cold medium, for example ambient air, is directed in heat exchange relation with the vaporous refrigerant flowing through the condenser. A fan 18 connected to a motor 20 is provided to supply the ambient air in the desired heat transfer relation with the vaporous refrigerant. The ambient air extracts heat from the vaporous refrigerant whereby the refrigerant is condensed.

The liquid refrigerant flows through conduit 22, thermal expansion device 24, and conduit 26, to a second heat exchanger 28 functioning as a refrigerant evaporator. Air to be cooled, is passed in heat transfer relation with the refrigerant flowing through heat exchange coil 28. The refrigerant absorbs heat from the air which is cooled thereby. A fan 30 suitably connected to motor 32 is provided to pass the air in the desired heat transfer relation. Conduit 33 delivers the vaporous refrigerant to the suction side of compressor 12. The refrigeration unit thus described is conventional within the art and no further explanation thereof is deemed necessary.

Figure 3:
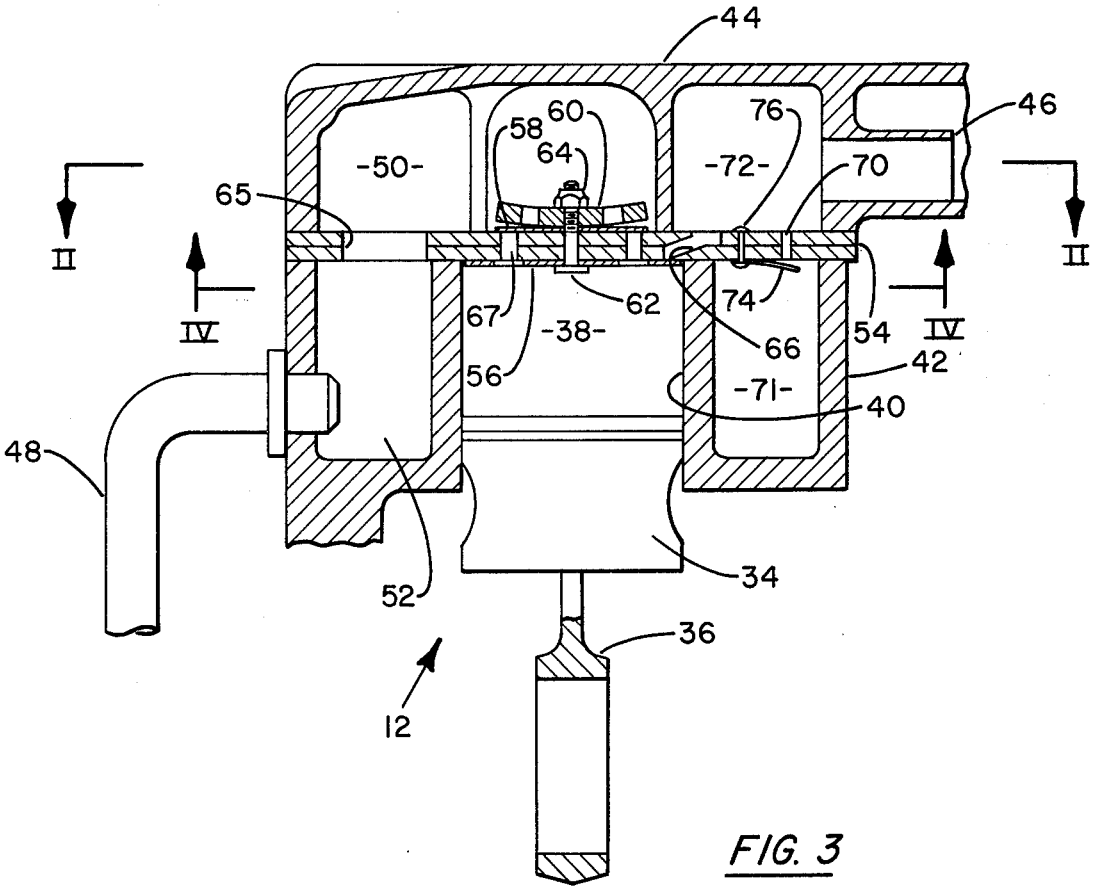
FIG. 3 is a sectional view of the compressor taken along line III—III of FIG. 2.

Referring now to FIG. 3, there is disclosed a sectional view of a portion of compressor 12. Compressor 12 is a reciprocating type compressor and includes a piston 34 connected via connecting rod 36 to a crank shaft (not shown). Piston 34 is adapted to reciprocate within cylinder 38 defined by walls 40 of cylinder block 42. Cylinder block 42 may be of the type disclosed in U.S. Pat. No. 3,785,453, issued Jan. 15, 1974, in the names of Salvatore Buonocore, Harvey G. Stenger and George T. Privon. Cylinder block 42 includes a number of interconnecting chambers, for example chambers 52 and 71 which are disposed radially about cylinder 38. Chambers 52 and 71 receive gas at discharge pressure from cylinder 38.

The compressor further includes cylinder head 44. Cylinder head 44 includes an opening or passage 46 through which suction gas is supplied to cylinder head 44 for eventual delivery to cylinder 38. Discharge line 48 communicates with chambers 50 and 52 respectively defined within the cylinder head and cylinder block. Line 48 delivers the compressed refrigerant gas from the compressor to conduit 14.

Figure 2:
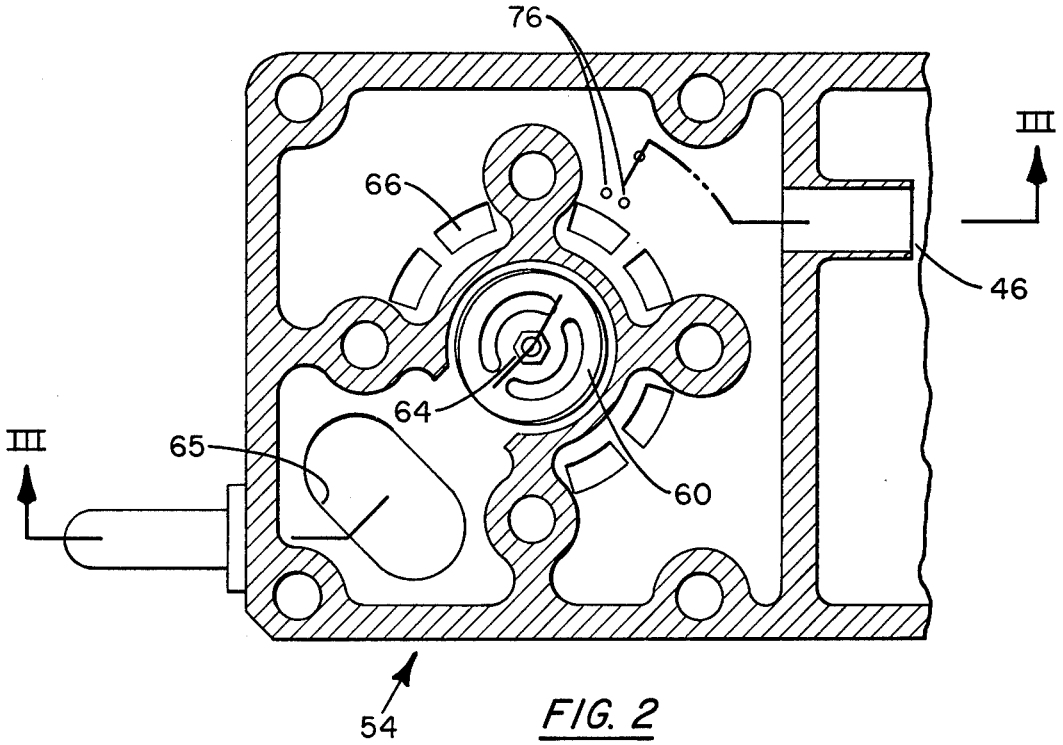
FIG. 2 is a sectional view of the compressor taken along line II—II of FIG. 3.
Figure 4:
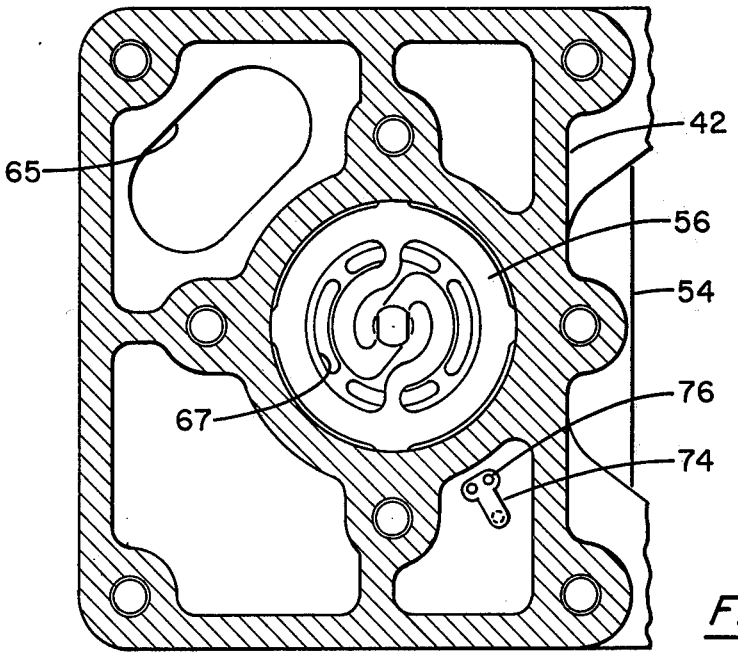
FIG. 4 is a further sectional view of the compressor taken along line IV—IV of FIG. 3.

The compressor further includes valve plate 54. As shown in FIGS. 2, 3, and 4, valve plate 54 mounts a suction valve 56 and a discharge valve 58. Guide 60 secured to the valve plate via bolt 62 and nut 64 limits the movement of discharge valve 58.

The valve plate includes a number of ports shown in detail in FIGS. 2, 3, and 4. Ports 67 are provided to permit a high pressure compressed gas to flow from cylinder 38 into chamber 49 in cylinder head 44 and then to discharge line 48. Port 65 in valve plate 54 communicates chamber 50 of the cylinder with chamber 52 of the cylinder block. Ports 66 are provided to permit suction gas to pass into cylinder 38 from suction chamber 72 in cylinder head 44.

The valve plate further includes ports 70 communicating discharge chamber 71 with suction chamber 72. Port 70 has a normally open heat responsive valve 74 disposed thereover to control the flow of fluid therethrough. Valve 74 is preferably formed from a bimetallic member. Valve 74 is connected to the valve plate via suitable means such as rivets 76.

Upon the initial startup of the compressor, refrigerant gas at suction pressure passes through ports 66 into cylinder 38 where the gas is compressed by operation of piston 34. A substantial portion of this gas is discharged outwardly through discharge ports 67 into chambers 50 and 52. A small portion of this gas passes outwardly through port 70 and returns to the suction side of the compressor to mix with the suction gas before it enters compressor cylinder 38. By permitting a portion of the discharge gas to mix with the suction gas, the temperature of the suction gas is increased thereby lowering its density. By decreasing the density of the suction gas, the compressor is required to do less work in compressing the gas to attain discharge pressure.

As noted previously, valve 74 is formed from heat responsive material such as a bimetallic element. As the temperature of the compressed gas increases, the valve warps to a closed position to interrupt the flow of compressed gas to suction chamber 72. The desired clearance between the valve and port 70 when the valve is in its normally open position can be accurately determined to insure that the valve will not close until the compressor motor has attained normal operating speed.

By permitting a portion of the compressed gas to mix with the suction gas, the density of the fluid is decreased. In addition, the suction pressure of the fluid is increased prior to its introduction into the cylinder. By decreasing the density and increasing the pressure of the fluid, the load imposed on the compressor motor during the startup thereof is decreased. Accordingly, the ability of the motor to provide sufficient starting torque to overcome the load initially imposed thereon is substantially increased.

Figure 5:
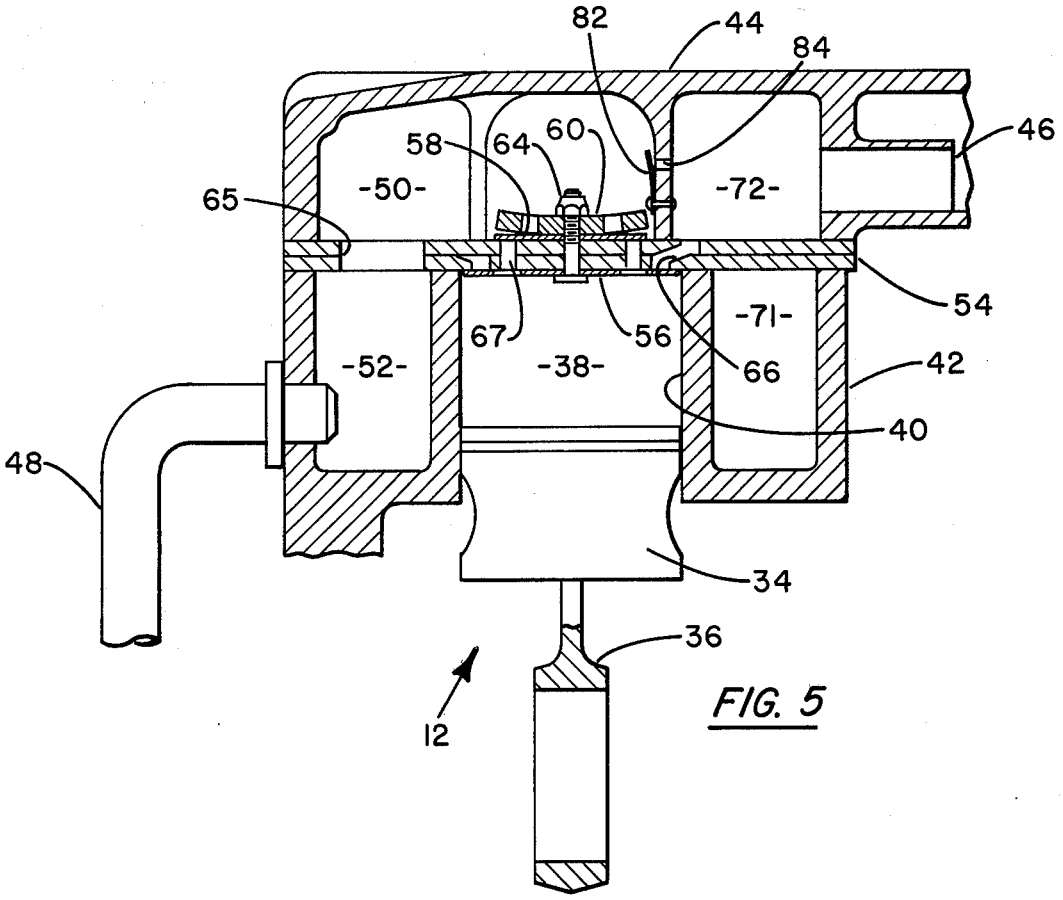
FIG. 5 is a sectional view of the compressor, similar to FIG. 3, illustrating a second embodiment of the present invention.

Referring now to FIG. 5, there is shown a second embodiment of the invention. FIG. 5 is identical to FIG. 3, except for the differences to be described in detail hereinafter. As noted previously, chamber 49 formed in cylinder head 44 is at discharge pressure, whereas chamber 72 formed in the head is at suction pressure. A normally open valve 82, similar to heat responsive valve 74 heretofore described, is provided within chamber 49. A port 84 is provided in the cylinder head communicating chamber 72 with chamber 49. Valve 82 is in a normally open position with respect to the port to permit high pressure discharge gas to pass from chamber 49 to chamber 72. Thus, valve 82 functions in a manner identical to that of valve 72.

In actual testing, a bimetallic element P675R mady by Texas Instruments, Incorporated was employed. The element comprised 72% manganese, 18% copper and 10% nickel. The initial curvature of the element was varied to cause the unloading valve to close at different time intervals after the compressor motor was energized. Preferably, a delay period of 1½1/2 minutes was established to accommodate extreme pressure differentials caused by high ambient temperatures.

The present invention provides a relatively inexpensive and highly efficient means to reduce the load on the compressor motor during startup thereof.

While preferred embodiments of the present invention have been described and illustrated, the invention should not be limited thereto but may be otherwise embodied within the scope of the following claims.

We claim:

1. In a reciprocating compressor operable to provide a relatively high pressure fluid and having a first portion operating at suction pressure and a second portion operating at discharge pressure, the improvement comprising:

conduit means to communicate the first portion operating at compressor suction pressure with the second portion operating at compressor discharge pressure; and a bimetallic valve directly responsive to the temperature of said fluid to control the flow of fluid through said conduit means, said valve being in a normally open position when the temperature of the fluid is at a relatively low temperature level to permit the flow of fluid from said second portion of said compressor to said first portion thereof, said valve moving to a closed position to terminate flow of fluid through said conduit means as the temperature of the fluid increases due to continued operation of said compressor.

2. The combination in accordance with claim 1 wherein the compressor is employed in a refrigeration unit.

3. The combination in accordance with claim 1 wherein the conduit means is formed in the compressor valve plate.

4. The combination in accordance with claim 1 wherein the conduit means is formed in the cylinder of the compressor.

5. A system for reducing the load on a reciprocating compressor during starting conditions comprising:

conduit means communicating a portion of said compressor operating at discharge pressure with a portion of said compressor operating at suction pressure; and a bimetallic valve directly responsive to the temperature of the fluid compressed by said compressor and operable to control the flow of said fluid through said conduit means, with said valve assuming an open position relative to said conduit means when the temperature of the fluid is at a relatively low level to permit the flow of fluid from said portion operating at discharge pressure to said portion operating at suction pressure, with said valve assuming a closed position relative to said conduit means to terminate flow of fluid therethrough when the temperature of the fluid increases to a predetermined level due to continued operaton of said compresser.

6. The system in accordance with claim 5 wherein the conduit means is formed in a valve plate of said compressor.

7. The system in accordance with claim 5 wherein the conduit means is formed in a cylinder head of said compressor.

* * * * *